US005483124A

United States Patent [19]

Kaviani

[11] Patent Number: 5,483,124

[45] Date of Patent: Jan. 9, 1996

[54] NEON ILLUMINATION SYSTEM

[75] Inventor: Ali Kaviani, Sicklerville, N.J.

[73] Assignee: Spencer Gifts, Inc., Pleasantville, N.J.

[21] Appl. No.: 233,492

[22] Filed: Apr. 26, 1994

[51] Int. Cl.[6] ..... H05B 37/00

[52] U.S. Cl. ..... 315/86; 315/90; 315/160; 315/209 R

[58] Field of Search ..... 315/209 R, 159, 315/149, 150, 158, 149, 160, 86, 90

[56] References Cited

U.S. PATENT DOCUMENTS 5,252,891 10/1993 Huang ..... 315/86

5,349,268 9/1994 Nagai et al. ..... 315/160

*Primary Examiner*—Robert J. Pascal

*Assistant Examiner*—Reginald A. Ratliff

*Attorney, Agent, or Firm*—Panitch Schwarze Jacobs & Nadel

[57] ABSTRACT

The invention is a source of illumination including a lighting tube requiring converted electrical energy in order to provide the illumination. First and second electrical connectors are provided for receiving low voltage DC energy. An energy convertor receives the low voltage DC energy from the first and second electrical connectors and converts it to the converted electrical energy. Electrical leads are coupled to the energy convertor and to the lighting tube for applying the converted electrical energy from the energy converter to the lighting tube. The first and second connectors are electrically coupled in parallel with each other for selectably applying the low voltage DC energy to the energy converter by way of either of the first and second converters. The lighting tube is a gas discharge tube and the first and second electrical connectors are disposed at opposite end regions of the lighting tube. Further electrical connectors are disposed at the opposite end of the tube and connected to the first and second electrical connectors by electrical lines extending within the source of illumination. The energy convertor converts the low voltage DC energy into high voltage, high frequency energy.

11 Claims, 4 Drawing Sheets

NEON ILLUMINATION SYSTEM

BACKGROUND OF THE INVENTION

The present invention relates generally to electrical lamps and, more particularly, to an assembly formed of gas discharge lamps which may be coupled in a variety of differing configurations.

Three basic types of light sources are available. They are incandescent lamps, fluorescent lamps and gas lamps wherein gas lamps include gas discharge lamps. Incandescent lamps produce light by electrically heating high resistance filaments thereby causing the filaments to glow. The filaments are usually formed as coiled tungsten wires and heated to incandescence by an electrical current passing through the filaments when the lamp is operating. The coiling of the tungsten filament increases the light producing efficiency. Filling an incandescent lamp with inert gas rather than normal atmospheric gases reduces tungsten evaporation and allows higher operation temperature of the filament.

Fluorescent lamps provide better energy efficiency than incandescent lamps because they convert more electrical energy into light energy and less into thermal energy. Therefore, fluorescent lamps are often preferred over incandescent lamps to reduce power consumption and heat generation. However, a fluorescent lamp circuit usually requires a ballast device. Ballast devices suitable for this purpose may be relatively large. Sometimes a starter device is also needed for fluorescent lamps. Since both of these devices can be somewhat bulky they can hamper the mounting of fluorescent lamps in some locations where it would be useful to save energy. This may be especially true where an incandescent light fixture is being replaced with a fluorescent fixture which must fit in the same amount of space.

Several methods of substituting fluorescent lamps for incandescent lamps to save energy have therefore been developed in the prior art. In U.S. Pat. No. 4,683,402, a fluorescent lamp adapter uses a toroidal ballast that fits around a fluorescent lamp socket. This design reduces the overall volume of the fluorescent adapter and allows threadable insertion of the adapter into a conventional incandescent lamp socket. In U.S. Pat. No. 4,645,283 a fluorescent lamp adapter has its ballast detachably connected to the side of the adapter case. This side mounted ballast may be removed to provide clearance so that the main adapter case can be threadably mounted into a lamp socket. The threaded base of the adapter case of this device ratchets to allow it to rotate after threading is complete. Once the main adapter case is properly positioned the side ballast can be attached. See also, example, U.S. Pat. Nos. 3,953,761; 4,363,083 and 4,841,193. These references contain other examples of substituting fluorescent lighting systems for incandescent lamps. While the use of these fluorescent lighting systems is an improvement over incandescent lamps, these fluorescent systems still have drawbacks.

Thus, rather than fluorescent lamps, other lamps using inert gases are sometimes used. Helium, neon, argon, krypton, radon, and xenon are elements which may serve as the inert gases for these lamps. Neon and argon are used in lighting tubes such as arc discharge tubes. Discharge lamps of the gas discharge type produce light by establishing an arc between two electrodes in an atmosphere of the gas at low pressure. Electrodes may also be used in high intensity gas discharge lamps. In the case of some high intensity gas discharge lamps the electrodes are located a few inches apart, at opposite ends of a small, sealed, translucent or transparent arc tube.

Lamps formed with inert gases can be formed into elongated shapes. There are numerous applications for elongated lamps of this type. One application is in situations where it is desired to arrange a plurality of lamps close together. For example, the elongated lamps may be arranged in a long straight line configuration, in a parallel configuration, or in angled or curved configurations. Such configurations are useful for lighting shelves, countertops, mirrors, and other common regions with similar geometries. In these applications it is desirable to avoid bulky ballast and starter devices.

U.S. Pat. No. 2,344,935, issued to Whitaker, describes an arrangement of elongated lamp fixtures. The fixtures taught by Whitaker include a channel member containing a starter and a control unit. Each fixture of the arrangement is also provided with a pair of spaced apart sockets at the ends of the channel member for receiving a replaceable fluorescent lamp. Each of the two sockets is provided with either a male connector or a female connector so that one fixture can be plugged into another to form a straight line of illumination fixtures. Angle blocks are also described in Whitaker for connecting the fixtures together at different angles. U.S. Pat. No. 2,652,483 to Laidig et al. describes arrangements of semicircular fluorescent lamps connected together in various configurations using connector blocks and other types of connection devices.

Neon tube lighting systems are also well known in the prior art of illumination devices. These lighting systems often include a plurality of neon tubes. In these systems the end of the material forming each neon tube may be bent back and the bent back portion of the tube may contain an electrode for causing the neon gas to glow. The electrode contained in this way may be connected by a wire to an electrically conductive metal cap. The metal cap may have a wire protruding from its end face for electrical connection to either an energy source or to the metal cap of an adjacent tube when two tubes are aligned in an endwise fashion and joined to each other.

It is also known in the art to provide electrical connectors for neon tubes supported in an end-to-end fashion. Examples of such connectors are shown in U.S. Pat. Nos. 1,817,543, 2,175,155, 2,238,589 and 4,947,301. U.S. Pat. No. 2,238,589 to Hensler, for example, discloses one such electrical connector having a pair of tubular sections. Each tubular section of the Hensler illumination system includes a closed outer end and telescopically engaged inner ends. The inner ends are axially interfitted within each other. A spring like electrical connector element is used to connect the ends of adjacent tubes.

A similar system is shown in U.S. Pat. No. 2,175,155 to Miller. The Miller reference discloses a jumper connector having a pair of hook ends. The hook ends are disposed in a confronting relation with each other. Each hook end has a tubular stem and the stems are adapted to interfit with to each other to form a telescoping structure. A coiled wire provides the electrical required connection for energizing the lamp in the Miller system.

It is well known to attach lamps serially wherein all of the serially attached lamps are in a single series electrical connection with each other. This series electrical arrangement has the disadvantage that if one bulb in the series fails to light, the entire series goes out. Furthermore, it may be difficult to determine which light in the series connection has failed. Also, in series electrical connections such as these, the voltage available for each light is the source voltage divided over the total number of lamps in the series. If, on the other hand, all the lamps are in a parallel arrangement, failure of one of the lamps does not affect the others. However, in a parallel arrangement such as this each lamp in the circuit is subjected to the full value of the line voltage unless a transformer is used.

Additionally, lamps may be joined in configurations which include both series electrical connections and parallel electrical connections. A common application of this type of configuration is in the field of miniature push-in type lamps. Normally, in a series-parallel configuration of lamps, the lampholders in each series set are interconnected using multiple short lengths of insulated lead wire connected to contact plates. This arrangement is shown, for example, in U.S. Pat. No. 3,104,924. The lead wires to and from the first and last lampholders in each series set are connected, respectively, to parallel wires from a power source such as a wall plug.

Alternatively, the connection to the parallel wires is made by interrupting the parallel wires at the first and last lamps of each series set and connecting both interrupted ends to the appropriate contact plate of the first and last lampholders. Hence, assembly of a series-parallel string of miniature lights has included the handling and end-stripping of a number of pieces of wire. Altering configurations of this type is thus time consuming. Additionally, there has been a need to wind the series wires and the parallel wires together between the lamps for ease of handling when deploying a string of lamps.

The above-described prior art connections do not provide electrical and mechanical connections between endwise-supported neon tubes which are secure enough and versatile enough for safe, convenient use. These prior art devices are also difficult to use without damaging the fragile neon tubes in many cases. Thus it is desirable to find a way to couple these prior art lamps which allows the lamps to be disposed in differing configurations with respect to each other while remaining security coupled in electrical contact and mechanical contact.

Briefly, the present invention is directed to an elongated neon lamp which is adapted to permit an assembly multiple neon lamps to be electrically coupled to each other and energized with a single low voltage DC energy source. Each neon lamp in the assembly is provided with a gas discharge lighting tube and at least two external connectors which are wired in parallel with each other within the neon lamp. Power from the single energy source is applied to either of the external connectors in order to power the neon lamp. A high voltage, high frequency inverter power supply is provided within the neon lamp for receiving the low voltage DC energy and producing a voltage suitable for energizing the gas discharge lighting tube. A linking power cable with a mating cable connector at each end is coupled to one of the remaining external connectors on the neon lamp. The connector at the remaining end of the cable may thus apply the low voltage DC energy to an additional neon lamp, including the inverter power supply of the additional neon lamp, to form a lighting assembly. The connector at the remaining end of the linking power cable may be coupled to any one of the external connectors of the additional neon lamp. Further neon lamps may be attached to the lighting assembly in the same manner. In this manner energy may be distributed to a number of gas discharge tubes using a single low voltage DC energy source provided it can produce sufficient current. The external connectors may be disposed, for example, at opposite ends of the neon lamp or at spaced apart locations on one end of the neon lamp.

SUMMARY OF THE INVENTION

The invention is a source of illumination including a lighting tube requiring converted electrical energy in order to provide the illumination. First and second electrical connectors are provided for receiving low voltage DC energy. An energy convertor receives the low voltage DC energy from the first and second electrical connectors and converts it to the converted electrical energy. Electrical leads are coupled to the energy convertor and to the lighting tube for applying the converted electrical energy from the energy converter to the lighting tube. The first and second connectors are electrically coupled in parallel with each other for selectably applying the low voltage DC energy to the energy converter by way of either of the first and second converters.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figure 1:
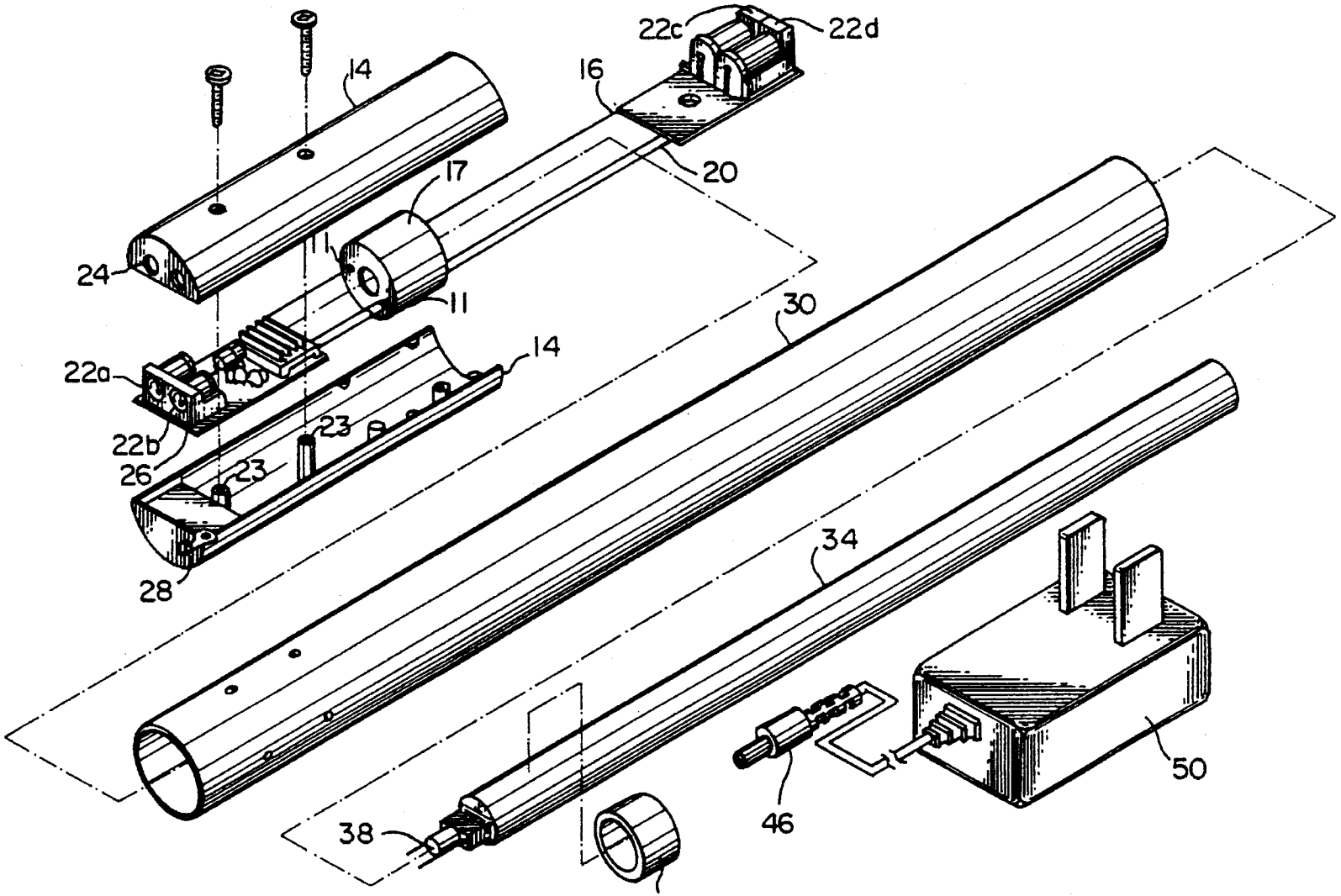
FIG. 1 is an exploded perspective view of an elongated neon lamp in accordance with a first embodiment of the present invention.

Referring to the drawings, wherein the same numerals are used to indicate like elements throughout, there is shown in FIG. 1 a preferred embodiment of an elongated neon lamp 10 in accordance with the present invention. The elongated neon lamp 10 includes a gas discharge lighting tube 34 having a tube electrode 38 at one of its ends for receiving energy to energize the gas discharge lighting tube 34 and provide illumination. In the preferred embodiment of the invention, the gas discharge lighting tube 34 is a gas discharge device which requires high frequency, high voltage excitation energy in order to provide illumination. Therefore, in order for the gas discharge lighting tube 34 to provide illumination, high frequency, high voltage energy must be applied to the tube electrode 38 within the neon lamp 10.

The gas discharge lighting tube 34 is disposed within an elongated protective pipe 30 in order to protect the lighting tube 34 from impacts. The protective pipe 30 which protects the gas discharge lighting tube 34 from impacts which may break it may be formed of any transparent or translucent material, such as acrylic or polyvinyl chloride, in order to permit illumination from the gas discharge lighting tube 34 to pass therethrough. Although the protective pipe 30 is shown as a circular pipe 30, it may be any type of casing which protects the gas tube 34 from impact and wear. A circular rubber cushion 42 and preferably two or more such cushions fit over each end of the gas discharge lighting tube 34 to provide a cushion between the protective pipe 30 and the gas discharge tube 34. The rubber cushions 42 also assist in holding the gas discharge tube 34 securely within the translucent protective pipe 30.

Two housing sections 14 may be joined together and secured to form a housing assembly at each end region of the translucent protective pipe 30, although this is only illustrated at one end region of the neon lamp 10 in FIG. 1 in order to simplify the drawing. A high voltage inverter 18 is provided within the housing assembly thus formed by the two housing sections 14 at one end region of the neon lamp 10 as illustrated in FIG. 1. The high voltage inverter 18 is disposed on a circuit board 26. The circuit board 26 also carries a number of external connectors 22*a*, 22*b* in addition to the high voltage inverter 18. Connector openings 24, through a housing section 14, provide external access to the connectors 22*a*, 22*b*.

The external connectors 22*a*, 22*b* are electrically coupled in parallel to each other on the circuit board 26. For example, the two external connectors 22*a*, 22*b* may be coaxial connectors each having a central conductor and a surrounding outer shield. In this case the central conductor of the coaxial connector 22*a* is directly electrically coupled to the central conductor of the connector 22*b*. Likewise, the surrounding shield of the connector 22*a* is directly electrically coupled to the surrounding shield of the connector 22*b*. Therefore, applying an electrical connection to either of the external connectors 22*a*, 22*b* shown is electrically equivalent to applying the electrical connection to the remaining external connector 22*a*, 22*b*.

It will be understood that any type of electrical connector may be used for the purpose of connectors 22*a*, 22*b* provided that it is effective to receive the required electrical energy and provided that it can be coupled in parallel to another connector in the manner described. Furthermore, it will be understood that any number of similar connectors may be provided in a parallel electrical coupling with each other in the vicinity of end of the neon lamps 10.

The external connectors 22*a*, 22*b* of the lamp receive low voltage DC energy by way of a power cable connector 46 of an AC-to-DC voltage adapter 50. For this purpose the power cable connector 46 is inserted through one of the connector openings 24 as previously described. The low voltage DC energy received by the external connectors 22*a*, 22*b* from voltage adapter 50 is applied to the high voltage inverter 18 on the circuit board 26. The high voltage inverter 18 converts the low voltage DC energy into the high frequency, high voltage energy required for energizing the gas discharge lighting tube 34 of the elongated neon lamp 10 and causing the lighting tube 34 to produce illumination.

In the preferred embodiment of the elongated neon lamp 10 a twelve volt DC input may be converted into 200 to 300 volts at a frequency of 110 KHz by the inverter 18. However, it will be understood that elongated tubes 34 requiring 2000 volts or more may be used within the neon lamp 10. Applications requiring higher voltages will require correspondingly lower current. Additionally, elongated tubes 34 operating at 900 KHz and higher may be used. In these cases an inverter 18 adapted to provide the required voltage, current and frequency from the low voltage source 50 is used.

The high voltage, high frequency energy from the high voltage inverter 18 is applied to the tube electrode 38 of the gas tube 34 by way of the high voltage electronic line 16 in the interior of the neon lamp 10. The manner in which the inverter 18 operates and the manner in which the output of the inverter 18 energizes the gas discharge tube 34 are well known in the art. Thus any circuit capable of receiving DC energy and suitable for converting the received DC energy into a form which is effective to energize the gas discharge tube 34 may be used in neon lamp 10. In the preferred embodiment of the neon lamp 10 the high voltage inverter 18 is provided with automatic frequency adjustment wherein the frequency output of the inverter 18 is adjusted according to input current in a manner well known to those skilled in the art.

The low voltage DC energy received by the external connectors 22*a*, 22*b*, in addition to being applied to the high voltage inverter 18, is applied to further external connectors such as connectors 22*c*, 22*d*. The further external connectors 22*c*, 22*d* may be located anywhere on elongated neon lamp 10 although, in one preferred embodiment, they are located in the end region opposite the end region of the electrical connectors 22*a*, 22*b*. The low voltage DC energy is applied to the further external connectors 22*c*, 22*d* by way of the DC power lines 20. As previously described with respect to the high voltage electronic line 16, the DC power lines 20 are also disposed within the neon lamp 10, specifically, within the protective pipe 30.

The further external connectors 22*c*, 22*d* are electrically coupled in parallel to each other and to the external connectors 22*a*, 22*b* as previously described with respect to the electrical coupling between the external connectors 22*a*, 22*b*. It will be understood that any number of external connectors may be provided in this manner and connected in parallel with each other, within the elongated neon lamp 10 even though only two are illustrated at each end. Furthermore, it will be understood that external connectors may be disposed anywhere on the elongated neon lamp 10 even though they are only illustrated in the vicinity of the ends of the neon tube 10.

To provide mechanical protection and to securely grasp the translucent protective pipe 30 within the neon lamp 10 a rubber cushion 17, shaped as a cap, is fitted over the ends of the protective pipe 30. The housing sections 14 at the ends of the elongated neon lamp 10 are adapted to securely grasp the outer surface of the rubber cushions 17 when they are secured to each other and thereby grasp the protective pipe 30 within the cushions 17. Additionally, the cushions 17 act as a frame within the housing.

Although the rubber cushion 17 is only shown at one end of the neon elongated lamp 10 in FIG. 1 in order to simplify the drawing, it will be understood that the opposite end of the elongated neon lamp 10 may be provided with a rubber cushion 17 within the housing sections 14 in the same manner for grasping the other end of the protective pipe 30 in order to mount further external connectors as described hereinbelow. The housing assemblies formed by the housing sections 14 which tightly grasp the outer surface of the other rubber cushion 17 at the two ends of the neon lamp 10 may be identical to each other.

The rubber cushion 17 at the end of the neon lamp 10 enclosing the high voltage inverter 18 is provided with conduit holes 11 for permitting the conductor lines 16, 20 to pass therethrough. When the housing sections 14 at this end of the elongated lamp 10 are secured to each other and tightly grasping the rubber cushion 17, the circuit board 26 carrying the external connectors 22*a*, 22*b* and the high voltage inverter 18 is secured against posts 23. In the preferred embodiment the posts 23 receive screws which pass through a housing section 14 and urge the two housing sections 14 against each other.

Figure 2:
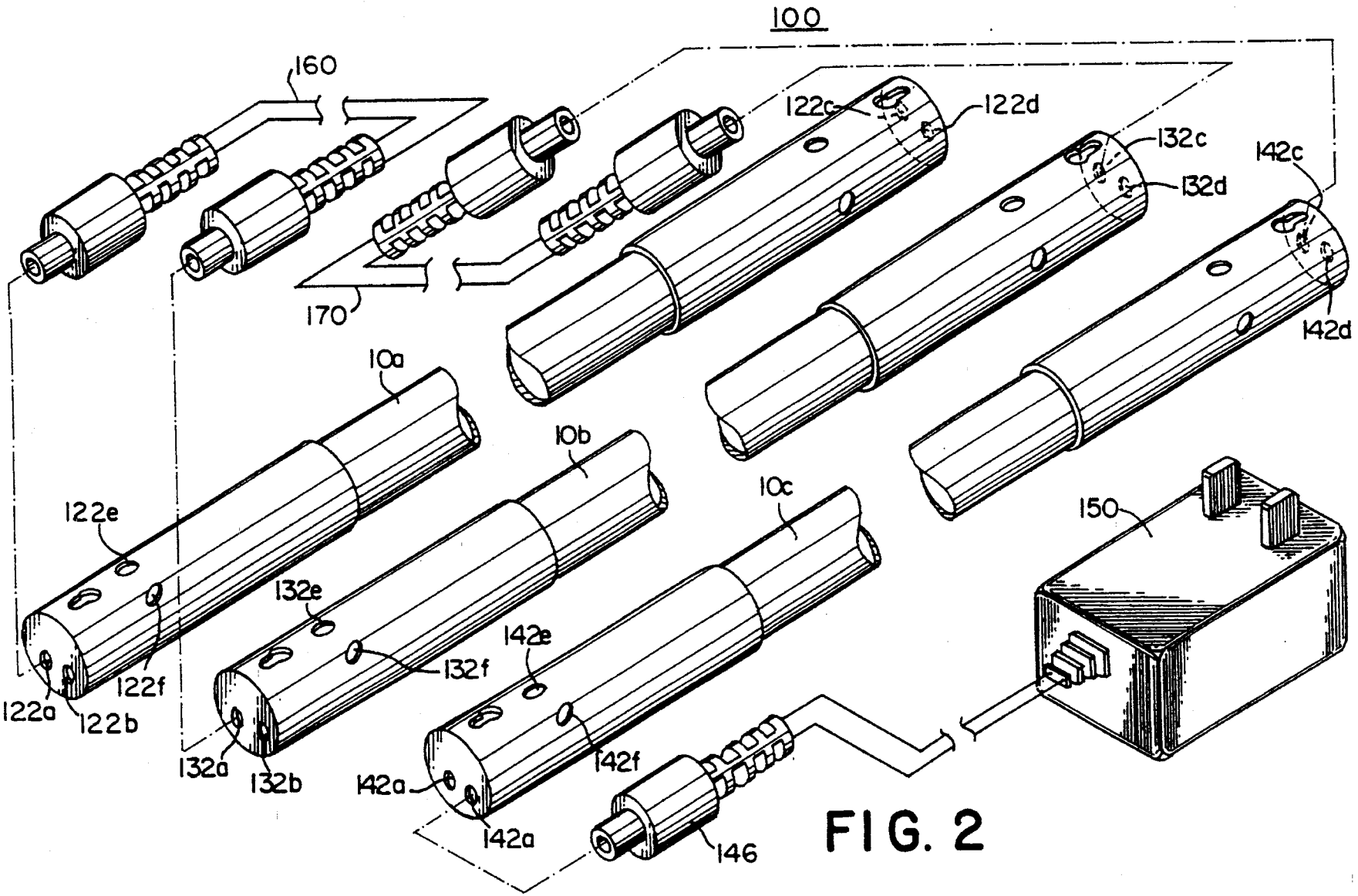
FIG. 2 is a perspective view of a neon illumination assembly formed of a plurality of the elongated neon lamps of FIG. 1 wherein the elongated neon lamps are coupled to each other in a parallel electrical connection.

Referring now to FIG. 2, there are shown elongated neon lamps 10*a*, 10*b*, 10*c*. Elongated neon lamps 10*a*, 10*b*, 10*c* are coupled to each other to form an illumination assembly 100. In the illumination assembly 100 the elongated neon lamps 10*a*, 10*b*, 10*c* are coupled to each other in a simple parallel electrical connection. The electrically parallel neon lamps 10*a*, 10*b*, 10*c* of the illumination assembly 100 are powered by a single, twelve volt DC power supply 150. The power supply 150 may be approximately 1500 ma for the three neon lamps 10*a*, 10*b*, 10*c* or 3.5 to 4.5 amps if the illumination assembly 100 is extended to seven or eight neon lamps 10. It will be understood that the amount of the current required from the power supply 150 varies according to the number of neon lamps coupled to each other and the length and thickness of the gas discharge tube 34.

A cable plug 146 of the power supply 150 is shown coupled to the external connector 142*b* of the neon lamp 10*c*. The low voltage DC electrical energy received by the elongated neon lamp 10*c* by way of the external connector 142*b* is applied to the high voltage inverter 18 within the neon lamp 10*c* as previously described with respect to the elongated neon lamp 10 of FIG. 1. As also previously described the high voltage inverter 18 within the elongated neon lamp 10*c* generates the high frequency, high voltage energy needed to energize a gas discharge lighting tube 34 within the neon lamp 10*c* and cause the gas within the lighting tube 34 to glow.

The low voltage DC energy received by way of the external connector 142*b*, in addition to being applied to the high voltage inverter 18 within the neon lamp 10c, is also applied in parallel to the external connector 142*a* by way of electrical coupling on the circuit board 26 within the neon lamp 10*c*. The same electrical energy is also applied to the external connectors 142*c*, 142*d* by way of the DC power lines 120 which extend from the circuit board 26 to the opposite end of the elongated neon lamp 10*c*. Thus the low voltage energy applied to the neon lamp 10*c* from the power source 150 is present at the external connector 142*a* and at the external connectors 142*c*, 142*d* at the opposite end of the neon lamp 10*c* and available for energizing the remaining neon lamps 10 within the illumination assembly 100.

In order to couple the elongated neon lamp 10*b* in a parallel electrical connection with the elongated neon lamp 10*c*, one end of an interlamp connector cable 170 may be coupled to either the external connector 142*c* or the external connector 142*d* of the elongated neon lamp 10*c*. Connector 170 may be any type of connector which can be coupled to the connectors at differing locations on neon lamps 10*a*, 10*b*, 10*c* and allow the neon lamps 10*a*, 10*b*, 10*c* thus coupled to be arranged at differing locations and differing angles with respect to each other. The remaining end of the interlamp connector cable 170 may be coupled to either the external connector 132*c* or the external connector 132*d* of the elongated neon lamp 10*b*. It will be recalled that the external connectors 132*c*, 132*d* are electrically equivalent to each other. Two additional external connectors 142*e*, 142*f*, also coupled in parallel with external connectors 142*a*, 142*b*, may also be provided on the neon lamp 10*c* to facilitate coupling the neon lamp 10*c* in other physical configurations.

In a similar manner the elongated neon lamp 10*a* may be electrically coupled in parallel with the neon lamp 10*b* of an illumination assembly 100. In order to make this connection one end of the interlamp connector cable 160 is applied either to the external connector 132*a* or to the external connector 132*b*. Either external connector 132*a*, 132*b* may be used because the connectors 132*a*, 132*b* are directly coupled in parallel with each other on the circuit board 26 within the neon lamp 10*b*. The remaining end of the interlamp cable 160 may then be coupled to either the connector 122*a* or connector 122*b* of the neon lamp 10*a*. The external connectors 122*a*, 122*b* are electrically connected in parallel to each other in the manner previously described. In this manner the neon lamps 10*a*, 10*b*, 10*c* of illumination assembly 100 are linked to each other in a manner which permits them to be disposed in many differing mechanical configurations and continuously energized while maintaining secure electrical and mechanical connections.

It will be understood that neon lamps 10*a*, 10*b*, of assembly 100 may be coupled to each other using the interlamp connector cable 160 in a number of other ways to achieve the same parallel electrical connection. For example, one end of the interlamp cable 160 may be coupled to the remaining external connector 132*c*, 132*d* of the neon lamp 10*b* not in use by the interlamp cable 170. The other end of the interlamp cable 160 may then be applied to one of the external connectors 122*a*, 122*b* of the neon lamp 10*a* or to the unused connector 122*c*, 122*d*.

Figure 3:
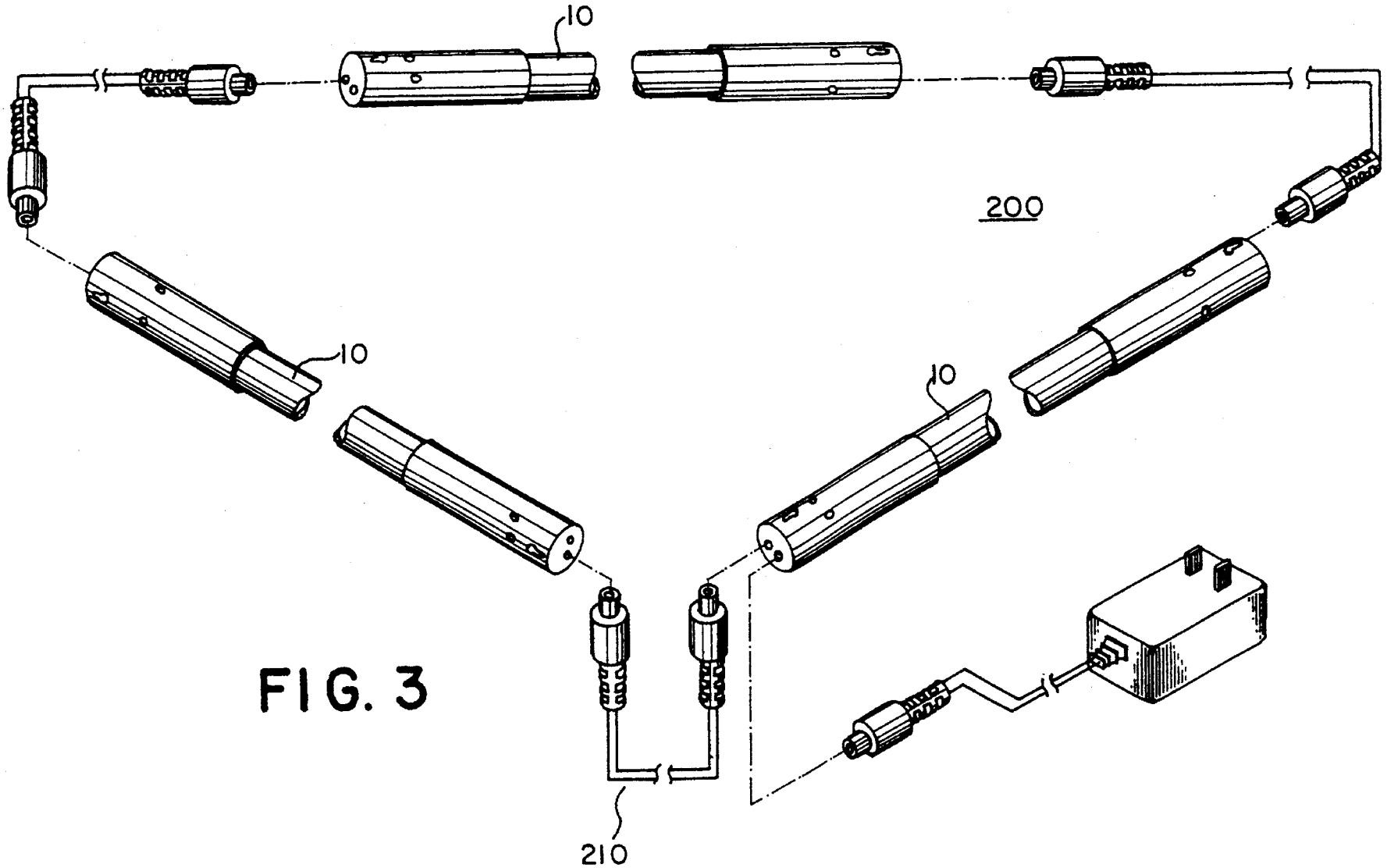
FIG. 3 is a neon illumination assembly formed of a plurality of the elongated neon lamp of FIG. 1 wherein the elongated neon lamps are arranged in a number of differing configurations.
Figure 4:
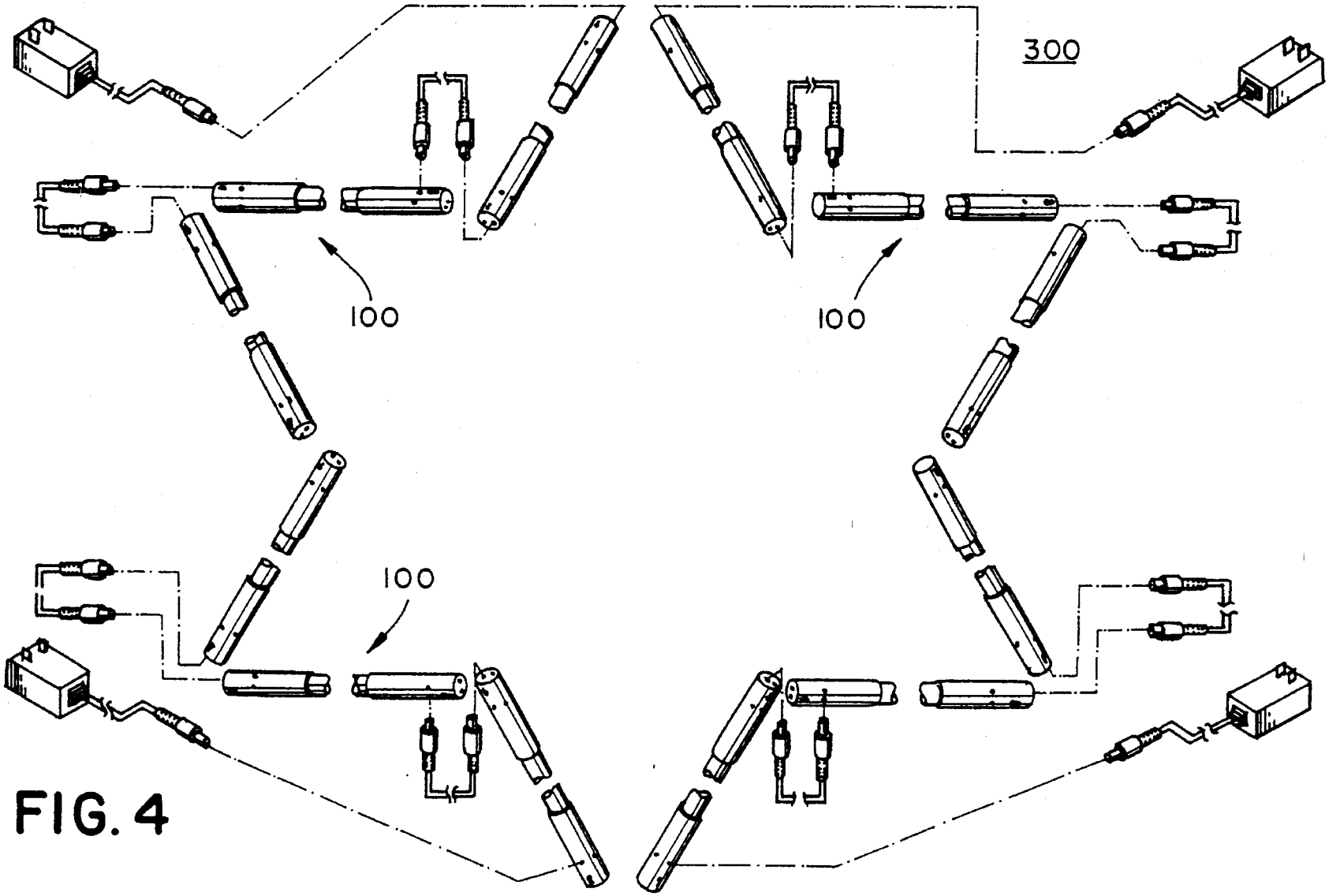
FIG. 4 is a neon lighting assembly formed of a plurality of the elongated neon lamps of FIG. 1 wherein the elongated neon lamps are coupled in a number of differing configurations.

Referring now to FIGS. 3 and 4, there are shown a variety of ways that the elongated neon lamps 10 of the present invention may be configured. In the illumination assembly 200 an additional interlamp connector cable 210 is added to the illumination assembly 100. It will be understood that this does not hamper the operation of the illumination assembly 100 because of the parallel electrical coupling of all electrical connectors within the lamps 10. Furthermore, it will be understood that further redundant or inadvertent coupling of external connectors within the illumination assembly 100 will not cause a short circuit or other interference within the assembly 100. In the illumination assembly 200 a number of the illumination assemblies 100 have been configured in a representation of a star. Because the cables of assemblies 100, 200 are flexible and they may be easily added and removed from the assemblies 200 and 300 and because they may be formed of any length, it is possible to form any configuration using lamps 10.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An assembly of elongated illumination sources, comprising:

first and second sources of illumination each requiring converted electrical energy to provide said illumination;

first and second electrical energy converters coupled to said first and second sources of illumination respectively for receiving low voltage DC energy and converting said low voltage DC energy to first and second supplies of said converted electrical energy;

first and second connectors electrically coupled to said first and second electrical energy converters, respectively, for receiving said low voltage DC energy and applying said low voltage DC energy to said first and second converters;

a single source of low voltage DC energy for applying said low voltage DC energy to a selected one of said first and second connectors to provide an energized connector and a remaining connector;

third and fourth connectors disposed upon said first and second sources of illumination, respectively, wherein said first connector is directly electrically coupled in parallel with said third electrical connector within said first source of illumination and said second electrical connector is directly electrically coupled in parallel with said fourth electrical connector within said second source of illumination; and an electrical connecting line external to said first and second sources of illumination electrically coupled to said remaining connector and to a selected one of said second and fourth electrical connectors thereby energizing both said first and said second sources of illumination.

2. The assembly of elongated illumination sources of claim 1, wherein said first and third connectors are disposed at opposite end regions of said first source of illumination.

3. The assembly of elongated illumination sources of claim 1, wherein said first and third connectors are disposed at the same end region of said first source of illumination.

4. The assembly of elongated illumination sources of claim 1, wherein at least one of said first and second sources of illumination is a gas discharge tube.

5. The assembly of elongated illumination sources of claim 1, wherein said converter comprises a high voltage converter.

6. The assembly of elongated illumination sources of claim 5, wherein said converter comprises a high frequency converter.

7. The source of illumination of claim 1, wherein said first and second electrical connectors are electrically coupled in parallel with each other by electrical lines extending within said source of illumination.

8. A source of illumination, comprising:

a gas discharge lighting tube requiring converted electrical energy in order to provide said illumination;

first and second low voltage electrical connectors for receiving low voltage DC energy;

an energy converter for receiving said low voltage DC energy from said first and second low voltage electrical connectors and converting said low voltage DC energy to said converted electrical energy; and electrical leads coupled to said energy converter and to said lighting tube for applying said converted electrical energy from said energy converter to said lighting tube, said first and second low voltage connectors being disposed at opposite end regions of said gas discharge lighting tube and electrically coupled in parallel to each other by electrical lines for providing said illumination when said low voltage DC energy is applied to said energy converter by way of either of said first or second connectors.

9. The source of illumination of claim 8, wherein said gas discharge lighting tube is enclosed within a protective casing.

10. The source of illumination of claim 9, wherein said electrical leads extend within said protective casing.

11. The source of illumination of claim 8, wherein said gas discharge tube is enclosed within a protective casing and said electrical lines extend within said protective casing.

* * * * *